United States Patent [19]

Forrest

[11] Patent Number: 4,984,373

[45] Date of Patent: Jan. 15, 1991

[54] ARCHERY BOW SIGHT

[76] Inventor: Richard M. Forrest, 8195 E. Nicaragua, Tucson, Ariz. 85730

[21] Appl. No.: 385,260

[22] Filed: Jul. 25, 1989

[51] Int. Cl.[5] ..... F41G 1/28; F41G 1/467

[52] U.S. Cl. ..... 33/265; 124/87

[58] Field of Search ..... 33/265, 263, 233, 237, 33/239, 246, 247, 249, 252; 124/87, 86; 403/374, 409.1, DIG. 8; 411/354, 362

[56] References Cited

U.S. PATENT DOCUMENTS

| | | | |
|---|---|---|---|
| 1,378,770 | 5/1921 | Downey et al. | 411/354 |
| 2,289,818 | 7/1942 | Winner et al. | 403/DIG. 8 |
| 2,332,080 | 10/1943 | Howe | 33/265 |
| 2,574,599 | 11/1951 | Stieber . | |
| 2,654,152 | 10/1953 | La Vire | 33/265 |
| 2,991,556 | 7/1961 | Wilchek | 33/265 |
| 3,234,651 | 2/1966 | Rivers | 33/265 |
| 3,475,820 | 11/1969 | Kernan | 33/265 |
| 3,590,489 | 7/1971 | Saunders | 33/265 |
| 3,696,517 | 10/1972 | Larson | 33/265 |
| 3,849,894 | 11/1974 | Brougham | 124/87 |
| 3,945,127 | 3/1976 | Spencer | 33/265 |
| 4,026,032 | 5/1977 | Smith | 33/265 |
| 4,170,071 | 10/1979 | Mann et al. | 124/87 |
| 4,283,157 | 8/1981 | Kowalski | 403/374 |
| 4,309,827 | 1/1982 | Larson | 33/265 |
| 4,325,190 | 4/1982 | Duerst | 33/265 |
| 4,449,303 | 5/1984 | Larson | 124/87 |
| 4,462,163 | 7/1984 | Tentler | 33/265 |
| 4,535,747 | 8/1985 | Kudlacek | 124/87 |
| 4,625,421 | 12/1986 | Strauss | 33/265 |
| 4,715,126 | 12/1987 | Holt | 33/265 |
| 4,757,614 | 7/1988 | Kudlacek | 33/265 |
| 4,786,204 | 11/1988 | Mayeda | 403/DIG. 8 |
| 4,819,611 | 4/1989 | Sappington | 124/87 |
| 4,846,141 | 7/1989 | Johnson | 124/87 |

*Primary Examiner*—William A. Cuchlinski, Jr.
*Assistant Examiner*—C. W. Fulton
*Attorney, Agent, or Firm*—Mark E. Ogram

[57] ABSTRACT

An archery bow sight wherein each sighting pin is a substantially straight rod extending through holes in a primary brace. The sighting pins are secured in position through the use of a cam mechanism that pinches or bends the sighting pins against the sides of the holes in the brace.

26 Claims, 2 Drawing Sheets

ARCHERY BOW SIGHT

BACKGROUND

This invention relates generally to archery and more particularly to sights for bows.

The original sights used for bows were rudimentary devices and provided, at best, an approximation. These included preset notches through which the target was sighted. One such sight was described in U.S. Pat. No. 2,574,599, entitled "Sighting Device for Bows and Arrows" issued Nov. 13, 1951, to Stieber.

The problems with such sights was that they did not permit any individual adjustments to compensate for the archer's personal situation such as weight of bow, draw length, sighting technique used by the archer, etc.

Approximately thirty years ago, the use of sights became more wide-spread with the introduction of improved sights. At that time, the archery bows in use were typically either straight bows or recurve bows. The concept was to provide a pin, preset for a particular distance, permitting the archer to maintain visual contact with the target and still adjust for elevation.

Generally these sights were composed of a series of threaded pins arranged vertically to each other. By threading/de-threading the pins during practice shots, and by sliding the pin up or down, the archer adjusted the pin for a particular distance.

To provide for easier visual differentiation of the end of the pin from the background, the pins typically contained a sighting bulb at their end. This bulb is a change in diameter (larger or smaller), a different color from the rest of the pin, or the like so that the end (the sight) can be easily identified.

Once the sight is set, in the field, the archer estimates the distance to the target, say 50 yards, and determines which pin is set for 50 yards. By placing the sighting bulb of the "50 yard" pin on the target after drawing back the bow, the archer automatically compensates for the correct elevation and maintains visual contact with the target.

Some of these type of sights are described in: U.S. Pat. No. 4,309,827, entitled "Adjustable Sighting Device for Archery Bows" issued Jan. 12, 1982, to Larson; U.S. Pat. No. 4,696,517, entitled "Range Finder and Bow Sight Device" issued Oct. 10, 1972, to Larson; U.S. Pat. No. 4,715,126, entitled "Archery Bow Sight" issued Dec. 29, 1987, to Holt; U.S. Pat. No. 4,819,611, entitled "Archery Bow Flexible Sight Pins" issued Apr. 11, 1989, to Sappington; U.S. Pat. No. 4,449,303, entitled "Sighting Screw Unit For and With Archery Bows" issued May 22, 1984, to Larson; U.S. Pat. No. 3,849,894, entitled "A Verticality Indicator and Adjustable Sighting Device for Archery Bows" issued Nov. 26, 1974, to Brougham; U.S. Pat. No. 3,590,489, entitled "Archery Bow Sighting Device" issued July 6, 1971, to Saunders; and U.S. Pat. No. 4,026,032, entitled "Bow Sight Mechanism" issued May 31, 1977, to Smith.

The new sights permitted the archer a much greater degree of control then was heretofore available and worked relatively well with these older, less powerful bows.

Although these sights did provide greater adjustment to compensate for the individual archer, they were bulky and lacked the ability to compensate for cross wind conditions.

In an effort to proved easy compensation for windage, a series of advancements were made which permitted the archer, in the field, to horizontally move the entire sight.

Some such sights are described in: U.S. Pat. No. 4,170,071, entitled "Sighting Apparatus" issued Oct. 9, 1979, to Mann et al.; U.S. Pat. No. 4,757,614, entitled "Archery Bow Sight" issued July 19, 1988, to Kudlacek; and, U.S. Pat. No. 4,625,421, entitled "Archery Bow Sighting Device" issued Dec. 2, 1986, to Strauss.

Although these improvements provided for adjustment for windage, they utilized the same basic structure for the holding and adjustment for the sighting pins, that of a screw mechanism. This type of mechanism required separate bulky mechanisms for each sighting pin as well as some mechanism to "lock" or secure the sighting pin in position once it had been properly adjusted.

This bulk, although not a problem with the earlier low powered bows (and hence slower arrows), proved to be particularly troublesome with the introduction of compound bows that propelled the arrow at much higher speeds.

Since the speed of the arrow determines the rate of drop, the sighting pins had to be placed closer to each other. Due to the bulk of the sights (individual screw mechanisms and locking mechanisms) a physical limit on the distance to the neighboring sighting pin was established. The sight limited the archer.

Some attempts were made to provide a set of sighting pins at closer intervals such as the use of beads on a wire. This type of arrangement is described in U.S. Pat. No. 3,234,651, entitled "Bow Sight" issued Feb. 15, 1966, to Rivers.

This arrangement did not permit the sighting beads to be adequately secured to the wire. During movement of the bow in the field, such beads were knocked by brush and such causing them to move and destroying their effectiveness.

It is clear from the forgoing that a sight suitable for high speed arrows does not exist.

SUMMARY OF THE INVENTION

The present invention recognizes the need for having closer placed sighting pins. To accomplish this, the sighting pins are simple rods without threads. The sighting pins are inserted through holes in a brace. A cam locks the pins in place by applying pressure against them and forcing the sighting pins against the walls of the holes in the brace.

By using straight rods for the sighting pins, the pins can be placed much closer to each other then was previously available. The size of the rod is the only determining factor for the distance between two contiguous sighting pins. The hole in the brace for the sighting pin need be only a very short distance removed from the neighboring hole so as to preserve the mechanical integrity of the bow sight.

As example, assume that each sighting pin has a diameter "d" and that the brace must have material "b" thick between holes. In this example, it is possible to place the two sighting pins a mere d+b from each other.

As the diameter of the sighting pin decreases, visually identifying the end of the sighting pin in a busy environment becomes a problem. To remedy this, a sighting bulb, such as a wider spot at the end of the pin (colored or not), is used to improve visibility of the sighting pin.

In the preferred embodiment, a single brace with holes is used. The sighting pins are inserted through the holes in the brace to be locked by the cam mechanism. In this embodiment, an optional stop mechanism is employed to control the depth that the sighing pins are inserted through the holes in the brace.

Although the preferred embodiment of the invention uses a single brace with holes, an alternative embodiment utilizes two braces with holes in each of them. In this embodiment, the sighting pin extends through the holes in the first brace and then through the holes in the second brace.

Securing the sighting pins in place becomes critical. In this invention, the use of a cam is the preferred embodiment. The cam is positioned on the opposite side of the brace away from the sighting bulb. When rotated, the cam presses or locks the sighting pins in place.

Placing the sighting bulb on one side of the brace while the cam mechanism operates on the opposite side prevents the cam mechanism from distorting or moving the sighting sighting bulb or the end of the sighing pin; their positions are maintained by the walls of the holes in the brace.

In the preferred embodiment of the cam mechanism, the cam has a substantially round cross section with one edge flattened. This flattened surface acts as a key. When the cam is turned so that the key is in line with the edge of the holes in the brace, the pins are easily inserted. After the pins are inserted and adjusted, the cam is rotated forcing the rounded edge of the cam to press against the pins, forcing them against the edge of the holes in the brace. This creates sufficient frictional force to secure the sighting pins.

A set screw or other locking mechanism is used to secure the cam after it has be turned to engage the sighting pins.

The invention, together with various embodiments thereof, will be more clearly defined by the following drawings and their descriptions.

DRAWINGS IN BRIEF

FIG. 1*a* is a side view of the functional elements of an embodiment of the invention.

FIGS. 1*b* and 1*c* are end views of the embodiment illustrated in FIG. 1*a*.

FIG. 2*a* is a side view of the functional elements of the preferred embodiment of the invention.

FIGS. 2*b* and 2*c* are end views of the preferred embodiment illustrated in FIG. 2*a*.

DRAWINGS IN DETAIL

Figure 1A:
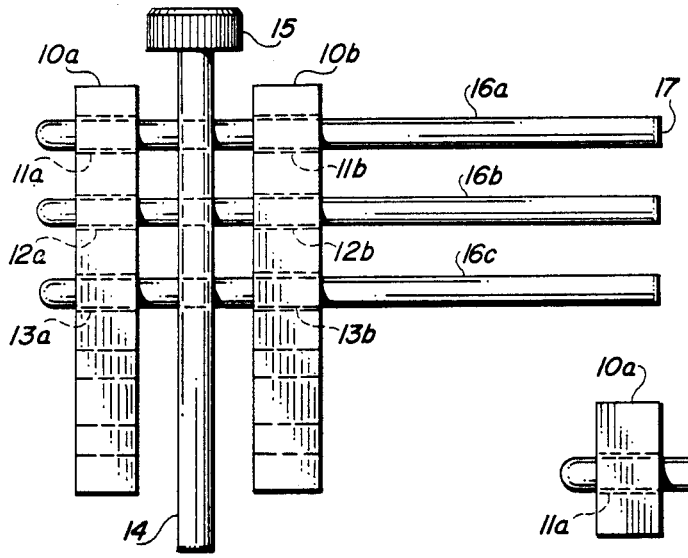

FIG. 1*a* illustrates the functional elements of an embodiment of the invention. Brace 10*a* and brace 10*b* provide the support for sighting pins 16*a*, 16*b*, and 16*c*. Each sighting pin extends through a hole in brace 10*b* and also through brace 10*a*. Hence, sighting pin 16*a* extends through hole 11*b* and hole 11*a*, sighting pin 16*b* extends through hole 12*b* and hole 12*a*, sighting pin 16*c* extends through hole 13*b* and hole 13*a*.

In this embodiment, each of these holes, such as hole 11*a*, are smooth bore. They are not threaded or serrated.

Each sighting pin, such as 16*a*, are rods having smooth sides permitting the sighting pin to slide easily through the smooth bore holes. The diameter of the sighting pin is only slightly smaller than the diameter of the hole. This eliminates any "wobble" or distortion of the sighting pin when it is secured into the sight.

Those of ordinary skill in the art readily recognize various choices for the diameter of the sighting pins and the holes in the braces.

To enhance visibility of the end of the sighting pin, such as 17, the end is optionally colored or has a sighting bulb (not shown).

A sighting bulb is an area of the sighting pin that is larger then the diameter of the pin. This makes the sighting bulb easy to visually identify. The sighting bulb, or the end of the sighting pin, is used to line-up with the target.

Cam 14 is used to lock pins 16*a*, 16*b*, and 16*c* in position. Locking of the pins is accomplished through rotation of handle 15 attached to cam 14.

The use of a cam to lock the sighting pins into place is the preferred embodiment, those of ordinary skill in the art readily recognize alternative mechanisms that can be used for this purpose including a pressure bar arrangement which screws down on the portion of the sighting pins 16*a*, 16*b*, and 16*c* which lie between brace 10*a* and brace 10*b*.

Figure 1B:
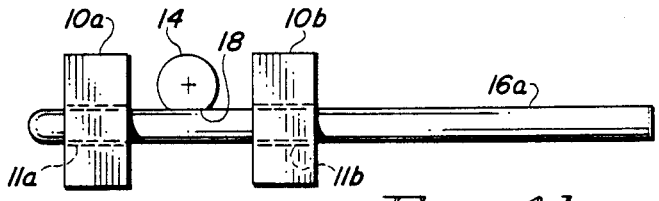
Figure 1C:
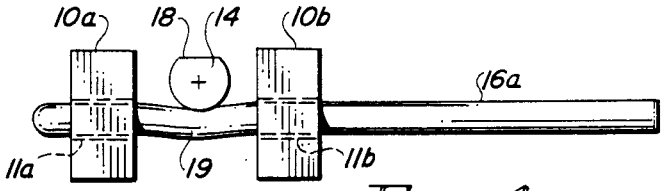

FIGS. 1*b* and 1*c* illustrate the use of the cam mechanism for locking the sighting pins in place within the mechanism of FIG. 1*a*.

In FIG. 1*b*, sighting pin 16*a* is extended through hole 11*b* in brace 10*b* and then through hole 11*a* in brace 10*a*.

Cam 14 has a substantially circular cross-section except with flattened key area 18. As illustrated in FIG. 1*b*, cam 14 is positioned so it can be rotated, placing key area 18 in a linear relationship with the edge of hole 11*a* and hole 11*b*. In this position, sighting pin 16*a* is inserted through hole 11*b* and hole 11*a* without interference.

Once sighting pin 16*a* has been positioned correctly, the archer rotates cam 14 via handle 15 (of FIG. 1*a*) so that the circular portion of cam 14 engages sighting pin 16*a*, as illustrated in FIG. 1*c*. This distorts sighting pin 16*a* as illustrated in exaggerated form by 19, pressing sighting pin 16*a* against the walls of hole 11*a* and 11*b*. This pressure, via frictional forces, secures sighting pin 16*a* from movement.

To readjust the sighting pin 16*a*, the operator need only reverse the process, placing the key area towards the sighting pin 16*a*.

Once the proper positioning of sighting pin 16*a* is obtained for the particular bow and archer, a set screw (not shown) or other type of locking mechanism is used to maintain the cam in position.

When using the cam mechanism for locking the sighting pins in place, it is ideal to maintain the diameter of the sighting pin close to the diameter of the hole. This reduces or eliminates any distortion of the sighting pin caused by the locking action of cam 14.

Figure 2A:
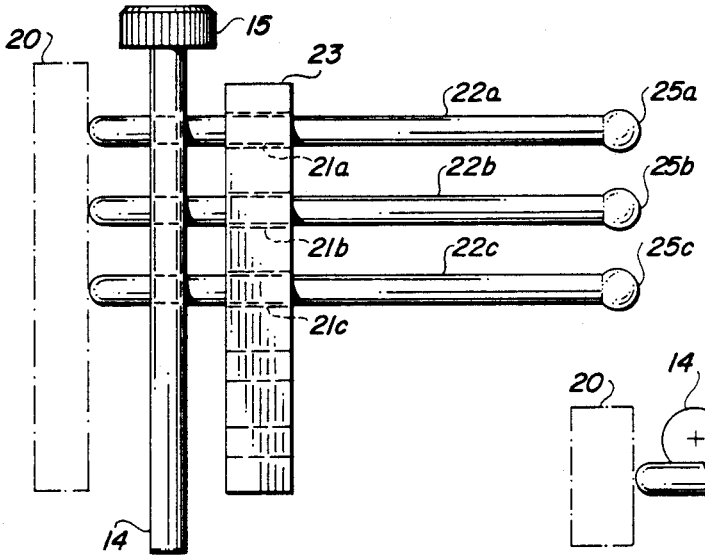

FIG. 2*a* is a functional layout of the preferred embodiment of the invention. In this embodiment, a single brace 23 is used. Smooth bore holes 21*a*, 21*b*, and 21*c* are bored through brace 23 permitting sighting pins 22*a*, 22*b*, and 22*c* to be inserted therethrough.

In this embodiment, sighting pins 22*a*, 22*b*, and 22*c* are equipped with sighting bulbs 25*a*, 25*b*, and 25*c* respectively.

Each sighting pin, such as sighting pin 22*a*, extends past cam 14 (as described in FIGS. 1*a*, 1*b*, and 1*c*). An optional stop mechanism 20 is positioned to stop the sighting pin 22*a* from being inserted an excessive amount through hole 21*a*.

Figure 2B:
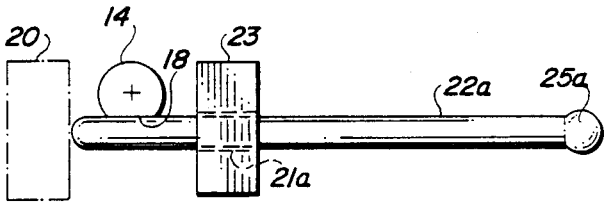
Figure 2C:
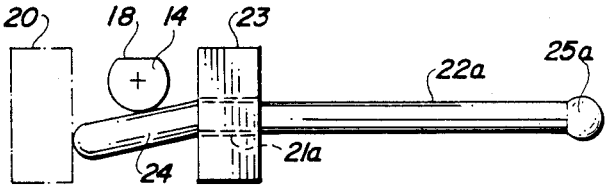

Referring to FIGS. 2*b* and 2*c*, side views of the embodiment illustrated in FIG. 2*a*, cam 14 has key 18 permitting sighting pin 22*a* to pass when key 18 is positioned in line with an edge of hole 21*a*.

Once the sighting pin 22*a* has been correctly positioned, cam 14 is rotated forcing the key 18 away from the sighting pin 22*a* and pressing the curved portion of cam 14 against sighting pin 22*a*. This distorts the end of sighting pin 22*a* as illustrated in exaggerated form by 24.

Although the end of sighting pin 22*a* is bent, the walls of hole 21*a* in brace 23 prevent the distortion of 24 to affect the alignment of the sight bulb 25*a*. In this manner, sighting pin 22*a* is firmly secured without modifying or changing the position of the sighting bulb 25*a*.

Figure 3:
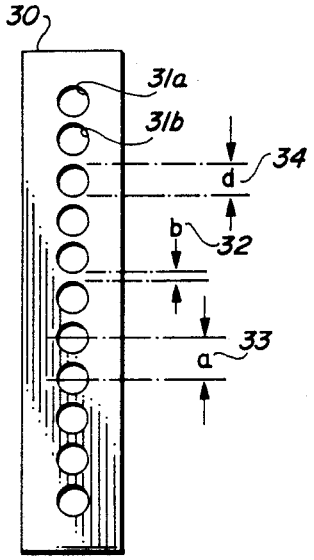
FIG. 3 is a side view of a brace of the an embodiment of the invention illustrating the placement of the holes.

FIG. 3 illustrates the advantage that the present invention provides, the placement of the sighting pins closer to each other so that proper sighting for the faster arrows.

Brace 30 has multiple holes bored therein such as hole 31*a* and hole 31*b*. Each hole has a diameter "d", 34. The holes are placed a distance "b", 32, from each other. Distance b, 32, is chosen to maintain the mechanical integrity of brace 30 and to provide the proper spacing for the sighting pins (not shown).

In this manner, the distance from center point of a sighting pin to center point of its nearest neighbor is: a=b+d, 33. This distance is substantially closer then is possible with the prior art and permits the bow sight of the present invention to be used for high powered bows and fast arrows.

Figure 4:
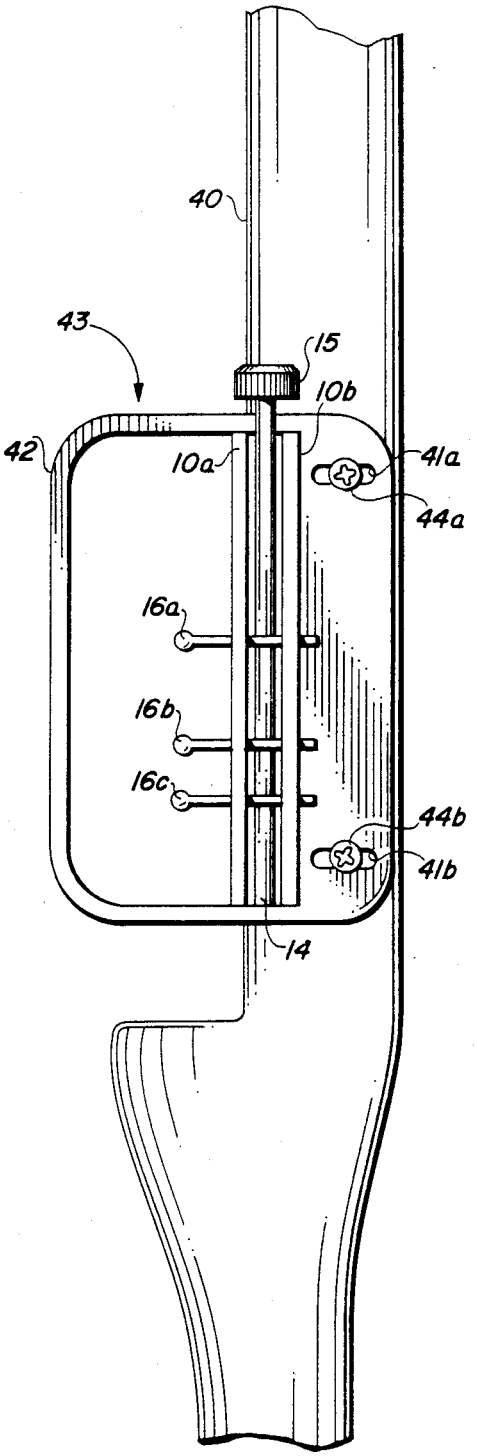
FIG. 4 is a side view of an embodiment of the invention mounted on an archery bow.

FIG. 4 illustrates an embodiment of the invention mounted on a bow. Sight 43 is attached to bow 40 via screws 44*a* and 44*b* located in slide adjustments 41*a* and 41*b* respectively. Slide adjustments 41*a* and 41*b* permit the archer to horizontally move the sight to compensate for windage and the like.

Within sight 43 is brace 10*b*, brace 10*a*, cam 14, and sighting pins 16*a*, 16*b*, and 16*c* which operate as described before.

Guard 42 extends around the outside of sighting pins 16*a*, 16*b*, and 16*c* to protect them during use in the field.

In this manner, the present invention provides a bow sight and bow assemblage which is vastly improved over the current art in that it permits the sighting pins to be positioned closer to each other.

I claim:

1. An archery bow sight comprising:

(a) a primary brace having at least two holes therethrough;

(c) at least two sighting pins, each of said sighting pins extending through a hole in the primary brace; and, (d) locking means for securing said sighting pins including cam means for simultaneously applying pressure against a portion of all of said sighting pins.

2. The archery bow sight according to claim 1 wherein said at least two holes in said primary brace are substantially smooth bore having a first diameter.

3. The archery bow sight according to claim 2 wherein said at least two sighting pins are rods having a diameter slightly less than said first diameter.

4. The archery bow sight according to claim 3 wherein each of said sighting pins has a sighting bulb thereon.

5. The archery bow sight according to claim 3 wherein said windage adjustment mechanism includes means for attaching said archery bow sight to an archery bow.

6. The archery bow sight according to claim 5 wherein said means for attachment includes means for varying the distance said primary brace is from the archery bow.

7. The archery bow sight according to claim 3 further comprising a windage adjustment mechanism for maintaining said primary brace and said cam mechanism in their positional relationship.

8. The archery bow sight according to claim 3 further comprising a stop mechanism for limiting the insertion of said sighting pins.

9. The archery bow sight according to claim 3 further comprising a secondary brace spaced apart from said primary brace and having at least two holes therethrough and wherein each of said at least two holes in said secondary brace is in linear relationship with a corresponding hole in said primary brace.

10. The archery bow sight according to claim 3 wherein said cam means has a substantially circular cross section with a flatten key area.

11. The archery bow sight according to claim 10 wherein said cam means is positioned such that said flattened key area is positionable to be in line with an edge of said at least two holes of said primary brace.

12. The archery bow sight according to claim 11 wherein said cam means further includes a handle for operator rotation of said cam means.

13. An archery bow sight comprising:

(a) a primary brace having a preselected number of smooth bore holes of a preselected diameter therethrough;

(b) at least two sighting pins, each of said sighting pins being a straight rod having a second diameter and having a sighting bulb attached to one end of said straight rod, each sighting pin extending through a hole in the primary brace;

(c) cam means for selectively and simultaneously applying pressure against a portion of all of said sighting pins; and, (d) a support means having, (1) means for maintaining said primary brace and said cam mechanism in their positional relationship, (2) means (a) for attaching said archery bow sight to an archery bow, and (b) for varying the distance said primary brace is from the archery bow, and, (3) a guard mechanism extending around the sighting bulbs.

14. The archery bow sight according to claim 13 wherein said cam means has a substantially circular cross section with a flatten key area.

15. The archery bow sight according to claim 14 wherein said cam means is positioned such that said flattened key area is positionable to be in line with an edge of said at least two holes of said primary brace.

16. The archery bow sight according to claim 15 wherein said cam means further includes a handle for operator rotation of said cam means.

17. The archery bow sight according to claim 13 wherein said sighting pins have a diameter slightly less than the preselected diameter of the holes in said primary brace.

18. The archery bow sight according to claim 13 further comprising a stop mechanism for limiting the insertion of said sighting pins through the holes in said primary brace.

19. The archery bow sight according to claim 13 further comprising a secondary brace spaced apart from said primary brace and having at least two holes therethrough and wherein each of said at least two holes in said secondary brace is in linear relationship with a corresponding hole in said primary brace.

20. An archery assemblage comprising:

(A) an archery bow; and, (B) an archery sight having, (1) a brace mechanism having a primary brace with a preselected number of smooth bore holes of a preselected diameter therethrough;

(2) at least two sighting pins, each of said sighting pins being a straight rod having a second diameter and having a sighting bulb attached to one end of said straight rod, each sighting pin extending through a hole in the primary brace;

(3) cam means for selectively and simultaneously applying pressure against a portion of all of said sighting pins; and, (4) a support means having, (a) means for maintaining said primary brace and said cam mechanism in their positional relationship, (b) means (1) for attaching said archery bow sight to an archery bow, and (2) for varying the distance said primary brace is from the archery bow, and, (c) a guard mechanism extending around the sighting bulbs.

21. The archery assemblage according to claim 20 wherein said cam means has a substantially circular cross section with a flatten key area.

22. The archery assemblage according to claim 21 wherein said cam means is positioned such that said flattened key area is positionable to be in line with an edge of said at least two holes of said first brace.

23. The archery assemblage according to claim 22 wherein said cam means further includes a handle for operator rotation of said cam means.

24. The archery assemblage according to claim 20 wherein said sighting pins have a diameter slightly less than the preselected diameter of the holes in said first brace.

25. The archery assemblage according to claim 20 further comprising a stop mechanism for limiting the insertion of said sighting pins through the holes in said primary brace.

26. The archery assemblage according to claim 20 further comprising a secondary brace spaced apart from said primary brace and having at least two holes therethrough and wherein each of said at least two holes in said secondary brace is in linear relationship with a corresponding hole in said primary brace.

* * * * *